United States Patent [19]

Forteau

[11] 3,982,683

[45] Sept. 28, 1976

[54] CARTON WITH POURING SPOUT

[75] Inventor: Lloyd H. Forteau, Brooklyn, N.Y.

[73] Assignee: Standard Folding Cartons, Inc., Jackson Heights, N.Y.

[22] Filed: June 4, 1975

[21] Appl. No.: 583,759

[52] U.S. Cl. ..... 229/17 R
[51] Int. Cl.[2] ..... B65D 5/72
[58] Field of Search ..... 229/17 R

[56] References Cited

UNITED STATES PATENTS

| | | | |
|---|---|---|---|
| 2,509,289 | 5/1950 | Dunning | 229/17 R |
| 2,616,610 | 11/1952 | Tomarin | 229/17 R |
| 3,133,688 | 5/1964 | Asman | 229/17 R |
| 3,306,514 | 2/1967 | MacKendrick | 229/17 R |
| R25,532 | 3/1964 | Asmam | 229/17 R |

*Primary Examiner*—Davis T. Moorhead
*Attorney, Agent, or Firm*—Pennie & Edmonds

[57] ABSTRACT

A carton with a reclosable pouring spout formed from a unitary carton blank. The carton blank is provided with appropriate fold lines to permit erecting into a carton having a diagonally angled upper corner panel recessed under the top and between the sides of the carton. The carton blank is provided with score lines positioned so as to extend across the upper corner panel of the completed carton. The carton is adapted to be broken along the score lines and the underlying section of the corner panel pulled outwardly to form a pour spout.

13 Claims, 4 Drawing Figures

CARTON WITH POURING SPOUT

BACKGROUND OF THE INVENTION

Many different carton blank designs have been devised for producing cartons with reclosable pouring spouts. A primary purpose of these prior constructions is to provide a unitary carton blank which will produce a carton with a reclosable pouring spout without requiring additional spout structure. With prior constructions, however, problems have been encountered in designing a blank capable of producing a carton which can be completely sealed and still permit opening into a spout shape. Complete sealing of the carton is especially desired where the carton is to be used to contain loose, fine, granular material. Any unsealed crevices will permit leakage of the material during handling and shipping. Obviously, this is undesirable both from the standpoint of material loss and appearance of the carton.

Further, with prior cartons constructed with pouring spouts, problems have been encountered with regard to the actual opening and closing of the spout. Desirably, a minimum understanding and manipulation of the spout should be required. Ideally, the appearance of the carton itself should clearly indicate to the consumer, without further instruction, how to open and close the pouring spout.

Prior unitary carton blank constructions designed for producing a carton with a reclosable pouring spout are exemplified by the following patents: Dunning U.S. Pat. No. 2,509,289, Asman, U.S. Pat. No. Re. 25,532, and MacKendrick, U.S. Pat. No. 3,306,514. Each of the above patents disclose carton blanks which are formed with fold and score lines so that in erected position, the carton may be broken along the score lines and fold along certain of the fold lines to provide a pouring spout. The constructions disclosed in the above patents, however, have the disadvantages of the prior art constructions discussed above.

In particular, the cartons of the Asman and MacKendrick patents cannot be completely sealed to prevent leakage of fine granular material; nor is it evident from the appearance of the carton itself how one is to form the pouring spout. Not only will instructions be needed to inform the consumer as to the opening procedure; but care must be taken in properly executing the instructions so as to avoid unwanted ripping of the carton.

In the Dunning patent, the formed carton can be completely sealed prior to the original opening of the pouring spout. However, the carton appearance does not readily advise the consumer as to the opening procedure. In addition, reclosing of the pouring spout cannot be made with assurance that the spout will remain closed.

SUMMARY OF THE PRESENT INVENTION

The carton blank of applicant's invention is generally similar in its basic construction to the carton blanks disclosed in the Asman and MacKenrick patents. That is, the completed carton will have a diagonally angled corner panel adapted to be manipulated to produce a pouring spout. In accordance with the teachings of applicant's invention, however, the section of the carton blank which is to form the corner panel is provided with certain fold and score lines which function to produce a pouring spout, the use of which is evident from the appearance of the erected carton. In addition, the fold and score lines which form the spout are so arranged to permit complete sealing of the carton during the original assembly thereof.

Basically, the corner panel of the carton is provided with a central score line extending across the panel and a pair of spout forming score lines extending from the ends of the central score line to the front diagonal edges of the carton. In addition, a pair of score lines extend upwardly away from the central score line to define a tab. This tab is adapted to be pushed inwardly of the corner panel by the consumer to permit grasping of the panel section below the tab. Pulling on this section will cause breaking along the spout forming score lines and result in opening of the panel into a pour spout.

DESCRIPTION OF THE PREFERRED EMBODIMENT

Figure 1:
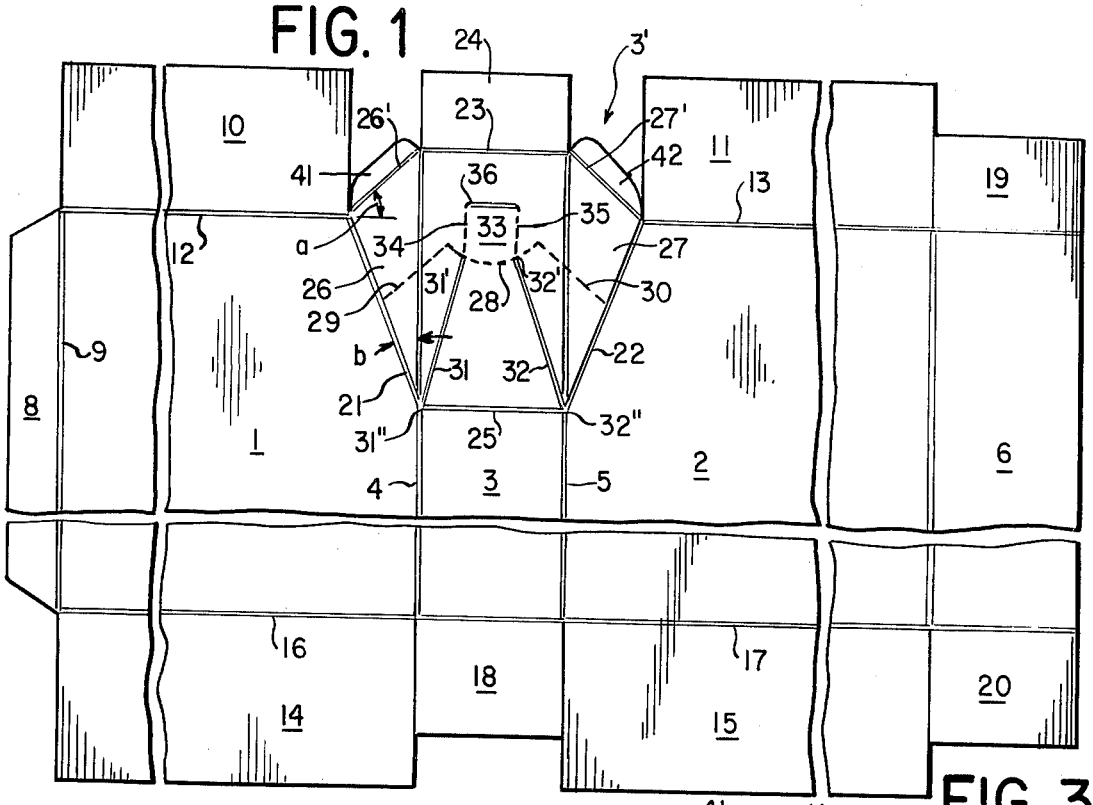
FIG. 1 is a plan view of the unitary carton blank constructed in accordance with the teachings of the present invention.

With reference to Fig. 1, the carton blank of the present invention has a basic construction like that disclosed in the Asman and MacKendrick patents. In particular, the blank is formed with a pair of spaced main side panels 1 and 2, a first end panel 3 disposed between the main panels, and separated therefrom by a pair of fold lines 4 and 5, a second end panel 6 hingedly connected to the main panel 2 along a fold line 7. The fold lines 4 and 5 will define the opposite edges of the first end panel and one edge of each of the main panels when the blank is erected into a carton. Similarly, the fold line 7 will form the edge of the carton between the main panel 2 and the other end panel 6. A sealing panel 8 is hingedly attached to the main panel 1 along the fold line 9 for gluing to the end panel 6. The fold line 9 will form the edge of the carton between the end panel 6 and the main panel 1.

Top end panels 10 and 11 are disposed along the top edges 12 and 13 of the main panels 1 and 2. The top edges of the main panels are, of course, defined by fold lines formed in the carton blank. In a similar manner, bottom end closure panels 14 and 15 are hingedly connected along the bottom edges 16 and 17 of the main panels 1 and 2, respectively. The end panels are also provided with the conventional top and bottom end closure panels as indicated at 18, 19 and 20.

In addition to the above basic structure of the carton blank, fold lines are provided for forming a diagonally angled corner panel on the completed carton. This corner panel is basically defined by the uppermost section of the end panel 3 and designated by reference numeral 3' in the drawings. It is produced in part by two diagonal fold lines 21 and 22 formed on the main panels 1 and 2. As seen from Fig. 1, diagonal fold line 21 is located in the upper corner of the main panel 1 and extends between the fold line 4 and the fold line 12. Similarly, the diagonal fold line 22 is located in the upper corner of the main panel 2 and extends between the fold line 5 and the fold line 13. In conjunction with the diagonal fold lines, the upper end closure panels 10 and 11 terminate at the intersection of these lines with the respepctive fold lines 12 and 13. Also, as seen from Fig. 1, the end panel 3 extends higher than the top edges of the main panels. The top edge of the end panel 3 is shown at 23 and is defined by a fold line. A top closure panel 24 is hingedly connected to the end panel 3 along this fold line 23. A final fold line 25 is formed across the end panel 3 between the points of the intersection of the diagonal lines 21 and 22 with the fold lines 4 and 5.

With the above construction, the portion of the side panel 3 disposed above the points of intersection of the diagonal lines 21 and 22 with the fold lines 4 and 5, that is, the area bordered by the fold lines 25, 4, 23, 5, defines the upper section 3' of the end panel and becomes the corner panel 3' of the completed carton.

Figure 2:
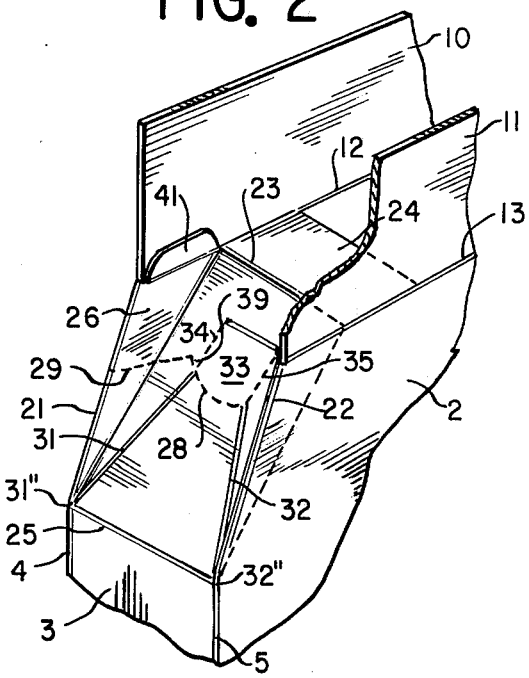
FIG. 2 is a perspective view of a partially completed carton.

In order to produce a neatly constructed corner panel, the sections 26, 27 of the panel located between the fold lines 4 and 5 and the adjacent diagonal fold lines 21 and 22 have upper edges 26' and 27' which are diagonally oriented. More particularly, they extend from the ends of the fold line 23 diagonally to the ends of the adjacent fold lines 12 and 13. Advantageously, the angle formed by the edges 26' and 27' and the respective fold lines 12 and 13 is constructed so that these edges will lie along the fold lines 12 and 13 when the carton is erected. This orientatiton is shown in Fig. 2. In order to provide this construction, the angle referred to above, which is designated *a* in Fig. 1, is made equal to twice the angle between the fold lines 4 and 5 and the adjacent diagonal fold lines 21 and 22, this latter angle being designated *b* in the drawings. By using this angle relationship, the blank will also permit folding of the upper section 3' of the side panel inwardly to form the corner panel of the carton with the top edge 23 also disposed in the plane of the upper edges of the main panels. This positioning is shown in Fig. 2 and will permit neat gluing of the top closure panel 24 to the overlying top closure panels 10 and 11.

The construction of the carton blank thus far described is conventional and is the same as disclosed, for example, in the Asman and MacKendrick patents. In accordance with the teachings of applicant's invention, the pour spout for the carton is produced by providing the blank with specially oriented score and fold lines. Generally these lines are formed in the upper section 3' of the end panel 3 and in the sections of the blank bordered by the diagonal fold lines 21, 22 and the fold lines 4 and 5. In particular, the upper section 3' of the end panel 3 is provided with a central score line 28 extending between the opposite fold lines or edges 4 and 5. In the preferred embodiment, the central score line is arcuate in shape with its ends 28', 28'' terminating at locations spaced from the fold lines 4 and 5. A pair of spout forming score lines 29 and 30 extend from the opposite ends 28', 28'' of the central fold line to the adjacentmost diagonal fold lines 21, 22. These score lines extend generally perpendicular to the fold lines 21, 22 and intersect centrally thereof.

In addition to the spout formed score lines 29 and 30, a pair of spout forming lines 31, 32 are provided on the carton blank. These fold lines extend from locations on the central score line 28 spaced inwardly from the ends 28', 28''. The points of intersection of the fold lines 31 and 32 with the arcuate central score line are shown in Fig. 1 at 31' and 32''. The spout forming fold lines 31 and 32 extend diagonally from the central score line to the points of intersection of the adjacentmost fold lines 21 and 22 with the fold lines 4 and 5. These points of intersection are shown in Fig. 1 at 31'' and 32''.

A puncturable tab 33 is formed above the central score line 28 by a pair of tab forming score lines 34, 35. As shown in Fig. 1, these score lines extend vertically upwardly from the central score line from the points of intersection 31', 32''. As also shown in Fig. 1, the uppermost ends of the tab forming score lines 34 and 35 are connected together by a tab forming fold line 36. The tab is thus defined by the arcuate score line 28 and the side score lines 34, 35, with the concave side of the score line 28 facing the tab forming fold line 36.

With the construction of the carton blank as described above, a completed carton may be formed in the usual manner; and as shown in Fig. 2, the carton will include corner panel 3' from which the pouring spout can be produced. In the erected condition of the carton, the sections 26 and 27 of the original carton blank, previously located between the end panel 3 and the diagonal fold lines 21 and 22, will now be disposed in flat relationship against the inside surfaces of the main panels 1 and 2. Also the top edges 12, 13, 23, 26 and 27 of the various panels will all lie in the same plane. Thus, in the completed carton, the corner panel 3' will be neatly positioned in recessed relation between the main panels and under the top closure panels.

Figure 3:
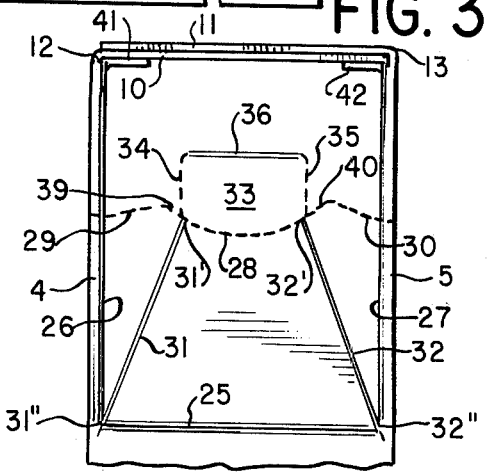
FIG. 3 is an end view of the carton showing the pouring spout in closed position.

Referring to Figs. 2 and 3, it will be seen that the tab 33 is centrally located on the corner panel and is of such a shape as to readily indicate that it is to be punctured with a finger to obtain access to the pouring spout. In this regard, the various fold lines and score lines will be formed in the conventional manner and this will readily indicate to the consumer that the score lines 28, 34 and 35 forming the tab as well as the score lines 28, 29 and 30 forming the upper edge of the spout are to be broken in order to open the spout. Normally, the score lines will show a partial break through the carton blank material and to be more apparent to the eye than the fold lines.

Figure 4:
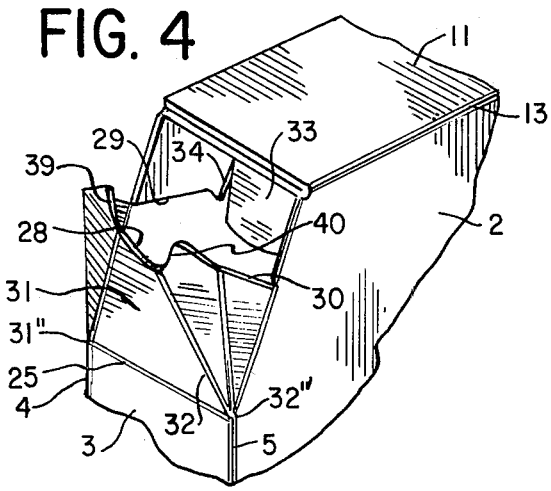
FIG. 4 is a perspective view of the carton with the pouring spout in opened position.

In opening the carton spout the user pushes his finger against the tab 33 to cause breakage along the score lines 28, 34 and 35. He then grips the upper back surface of the section of the panel below the score line 28 and pulls outwardly. This action breaks the carton along the score lines 29 and 30 to produce the opened spout as shown in Fig. 4. As the spout is formed, the panel 3' folds along the fold lines 31 and 32 to provide a tapered spout configuration. Also, by having these fold lines intersect the score line 28 intermediate its ends, and by forming the line 28 in an arcuate shape, the spout is formed with side edges 39, 40. These edges assist in properly directing the flow of the contents from the spout.

When it is desired to close the pouring spout, it is simply necessary to push the spout inwardly toward its original recessed position. As this occurs, the sections 26, 27 disposed below the score lines 29 and 30 will snap back into flat engagement with the inner surfaces of the main panels 1 and 2. At the same time, the panel 3' will take on a planar shape and hold the spout closed.

In accordance with a further aspect of the present invention, it is to be noted that only the portions of the sections 26, 27 below the score lines 29 and 30 are manipulated in forming the pouring spout. Accordingly, above the score lines 29 and 30, these sections 26, 27 can be glued to the inner surfaces of the adjacent main panels. With this gluing and also with the gluing of the panel 24 to the overlying panels 10 and 11, a completely sealed carton will be produced. No leakage of the contents of the carton will be possible. As shown in the drawings, the sections 26 and 27 may be provided with hinged flaps 41 and 42. Where these flaps are provided, they will be folded during the carton erecting process to underlie the top closure panels 10 and 11. Advantageously, these flaps may be glued to the top panels where it is not convenient or desirable to glue the sections 26 and 27 to the main panels 1 and 2.

Although the above description has been made with respect to the presently preferred construction, it is to be understood that various modifications can be made thereto. For example, the central score line 28 can be straight. Also, this line can extend completely across the upper section 3' of the side panel 3, in which case the score lines 29 and 30 will be formed only in the panel sections 26 and 27. Also, the location of the intersection of the spout forming fold lines 31 and 32 with the central score line may be changed depending on the desired configuration of the spout.

I claim:

1. In a unitary carton blank adapted to be erected into a carton having a reclosable pouring spout, said blank having a pair of spaced main panels, a first end panel disposed between said main panels and separated therefrom by a pair of first fold lines defining the opposite edges of the end panel and one edge of each of the main panels, a second end panel hingedly connected along the other edge of one of said main panels, a top end closure panel disposed along the top edge of each of said main panels and separated therefrom by a second fold line, a bottom end closure panel hingedly connected along the bottom edge of each of said main panels, a diagonal fold line on each main panel extending between the first fold line and the second fold in the upper corner adjacent the first end panel, each of said top end closure panels terminating at the intersection of the adjacent diagonal fold line with the second fold line, and the first end panel extending higher than the top edges of the main panels and defining an upper section above the intersection of the diagonal fold lines with the first pair of fold lines whereby said blank when erected forms a carton with a diagonally angled upper corner panel recessed between the main panels and under top closure panels for opening into a pouring spout, the improvement comprising:

a. a central score line formed in the upper section of the end side panel between the opposite edges thereof; and b. a pair of spout forming score lines extending from the opposite ends of the central score line to the diagonal fold lines intermediate their ends.

2. The improvement in the carton blank of claim 1 further comprising:

a. a pair of tab forming score lines, each of which extends from adjacent one end of the central score line and in a direction toward but spaced from the top edge of the upper section of the first end panel.

3. In a unitary carton blank adapted to be erected into a carton having a reclosable pouring spout, said blank having a pair of spaced main panels, a first end disposed between said main panels and separated therefrom by a pair of first fold lines defining the opposite edges of the end panel and one edge of each of the main panels, a second end panel hingedly connected along the other edge of one of said main panels, a top end closure panel disposed along the top edge of each of said main panels and separated therefrom by a second fold line, a bottom end closure panel hingedly connected along the bottom edge of each of said main panels, a diagonal fold line on each main panel extending between the first fold line and the second fold in the upper corner adjacent the first end panel, each of said top end closure panels terminating at the intersection of the adjacent diagonal fold line with the second fold line, and the first end panel extending higher than the top edges of the main panels and defining an upper section above the intersection of the diagonal fold lines with the first pair of fold lines whereby said blank when erected forms a carton with a diagonally angled upper corner panel recessed between the main panels and under the top closure panels for opening into a pouring spout, the improvement comprising:

a. a central score line formed in the upper section of the end side panel between the opposite edges thereof;

b. a pair of spout forming score lines extending from the opposite ends of the central score line to the diagonal fold lines intermediate their ends;

c. a pair of tab forming score lines, each of which extends from adjacent one end of the central score line and in a direction toward but spaced from the top edge of the upper section of the first end panel; and d. a tab forming fold line extending between the uppermost ends of the tab forming score lines.

4. The improvement in the carton blank of claim 3 further comprising:

a. a pair of spout forming fold lines, one of which extends from adjacent one end of the central score line to the point of intersection of the adjacentmost diagonal fold line with the adjacent one of the first pair of fold lines, and the other of which extends from adjacent the other end of the central score line to the point of intersection of the other of the diagonal fold lines with the other of the first pair of fold lines.

5. The improvement in the carton blank of claim 4 wherein:

a. the central score line is arcuate in shape with the concave side thereof facing toward the tab forming fold line.

6. The improvement in the carton blank of claim 5 wherein:

a. the spout forming fold lines extend from locations on the central score line spaced from the ends of said score line; and b. the tab forming score lines extend from the same locations on the central score line as the spout forming fold lines.

7. The improvement in the carton blank of claim 6 further comprising:

a. a top end closure panel hingedly connected along the top edge of the upper section of the first end panel.

8. In a carton having a reclosable pouring spout and formed from a unitary blank having a pair of spaced main panels, a first end panel disposed between said main panels and separated therefrom by a pair of first fold lines defining the opposite edges of the end panel and one edge of each of the main panels, a second end panel hingedly connected along the other edge of one of said main panels, a top end closure panel disposed along the top edge of each of said main panels and separated therefrom by a second fold line, a bottom end closure panel hingedly connected along the bottom of each of said main panels, a diagonal fold line on each main panel extending between the first fold line and the second fold in the upper corner adjacent the first end panel, each of said top end closure panels terminating at the intersection of the adjacent diagonal fold line with the second fold line, and the first end panel extending higher than the top edges of the main panels and defining an upper section above the intersection of the diagonal fold lines with the first pair of fold lines whereby said blank when erected forms a carton with a diagonally angled upper corner panel recessed between the main panels and under the top closure panels for opening into a pouring spout, the improvement comprising:

a. a central score line formed in the upper section of the first end panel between the opposite edges thereof; and b. a pair of spout forming score lines extending from the opposite ends of the central score line to the diagonal fold lines intermediate their ends.

9. The improvement in the carton of claim 8 wherein:

a. the sections of the carton blank located between the upper section of the first end panel and the diagonal fold lines are disposed in flat relationship against the inside surfaces of the main panels when the carton is in closed position.

10. The improvement in the carton of claim 9 further comprising:

a. a top end closure panel hingedly connected along the top edge of the upper section of the first end panel.

11. The improvement in the carton of claim 10 wherein:

a. the top end closure panels are all glued to each other; and b. the sections of the carton blank disposed in flat relationship against the inside surface of the main panels are glued thereto above the location of the spout forming score lines.

12. The improvement in the carton of claim 10 wherein:

a. the sections of the carton blank disposed between the upper section of the first end panel and the disposed in underlying relation to the top closure panels in the erected carton; and b. the flap and top end closure panels are all glued to each other to seal the top of the carton against leakage.

13. In a carton having a reclosable pouring spout and formed from a unitary blank having a pair of spaced main panels, a first end panel disposed between said main panels and separated therefrom by a pair of first fold lines defining the opposite edges of the end panel and one edge of each of the main panels, a second end panel hingedly connected along the other edge of one of said main panels, a top end closure panel disposed along the top edge of each of said main panels and separated therefrom by a second fold line, a bottom end closure panel hingedly connected along the bottom edge of each of said main panels, a diagonal fold line on each main panel extending between the first fold line and the second fold in the upper corner adjacent the first end panel, each of said top end closure panels terminating at the intersection of the adjacent diagonal fold line with the second fold line, and the first end panel extending higher than the top edges of the main panels and defining an upper section above the intersection of the diagonal fold lines with the first pair of fold lines whereby said blank when erected forms a carton with a diagonally angled upper corner panel recessed between the main panels and under the top closure panels for opening into a pouring spout, the improvement comprising:

a. a central score line formed in the upper section of the first end panel between the opposite edges thereof;

b. a pair of spout forming score lines extending from the opposite ends of the central score line to the diagonal fold lines intermediate their ends;

c. a pair of tab forming score lines, each of which extends from adjacent one end of the central score line and in a direction toward but spaced from the top edge of the upper section of the first end panel; and d. a tab forming fold line extending between the uppermost ends of the tab forming score lines.

* * * * *

UNITED STATES PATENT AND TRADEMARK OFFICE

CERTIFICATE OF CORRECTION

PATENT NO. : 3,982,683

DATED : September 28, 1976

INVENTOR(S) : Lloyd H. Forteau

It is certified that error appears in the above-identified patent and that said Letters Patent are hereby corrected as shown below:

In the References, R25,532 3/1964 "Asmam" should read --Asman-

Column 3, line 4, "respepctive" should read --respective--;
line 29, "orientatiton" should read --orientation--;
line 68, "32"" should read --32'--.

Column 4, line 9, "32"" should read --32'--;
lines 9-10, "uppermost ends" should read --upper ends--

Column 5, line 49, "under top" should read --under the top--;
lines 65-66, "end disposed" should read --end panel disposed--.

Column 7, lines 4-5, "bottom of" should read --bottom edge of-

Column 8, lines 2-3, "and the disposed" should read --and the diagonal fold lines include hinged flaps disposed--.

Signed and Sealed this

Twenty-sixth Day of April 1977

[SEAL]

*Attest:*

RUTH C. MASON
*Attesting Officer*

C. MARSHALL DANN
*Commissioner of Patents and Trademarks*